US011511408B1

(12) United States Patent
Holley, Sr.

(10) Patent No.: US 11,511,408 B1
(45) Date of Patent: Nov. 29, 2022

(54) IMPACT HAND TOOL

(71) Applicant: William E. Holley, Sr., Tama, FL (US)

(72) Inventor: William E. Holley, Sr., Tama, FL (US)

( * ) Notice: Subject to any disclaimer, the term of this patent is extended or adjusted under 35 U.S.C. 154(b) by 0 days.

(21) Appl. No.: 16/873,697

(22) Filed: Jun. 1, 2020

(51) Int. Cl.
*B25G 1/10* (2006.01)
*B25D 1/04* (2006.01)

(52) U.S. Cl.
CPC ..... *B25G 1/102* (2013.01); *B25D 1/04* (2013.01)

(58) Field of Classification Search
CPC . B25G 1/102; B25G 1/10; B25G 1/06; B25G 1/00; B25D 1/04; B25D 1/045; B25D 1/12; Y10T 16/476; Y10T 16/469; Y10T 16/4713; Y10T 16/506; Y10T 403/7073; Y10T 74/20828; A01D 1/14
USPC ..... 81/20, 22, 488
See application file for complete search history.

(56) References Cited

U.S. PATENT DOCUMENTS

2006/0021474 A1* 2/2006 Burgess ..... B25D 1/04 81/26
2006/0183608 A1* 8/2006 Sumner ..... A63B 23/16 482/108
2007/0163395 A1* 7/2007 Wagner ..... B25G 1/102 81/20
2016/0115007 A1* 4/2016 Liou ..... B66F 15/00 7/166

FOREIGN PATENT DOCUMENTS

EP 0727288 A1 * 8/1996 ..... B25G 1/102

OTHER PUBLICATIONS

AntiquesNavigator.com_Vintage_Hammer https://www.antiquesnavigator.com/d-3065316/vintage-blacksmith-hammer--chisel-tool-lot-unusual-anvil-forging-tools.html (Year: 2018).*

* cited by examiner

*Primary Examiner* — Orlando E Aviles
*Assistant Examiner* — Jacob Adam Montgomery
(74) *Attorney, Agent, or Firm* — Arthur W. Fisher, III

(57) ABSTRACT

An impact hand tool comprising an impact head including an impact surface to engage a work piece and an enlarged hand grip including a palm engaging surface to engage at least a major portion of a person's palm interconnected by an elongated handle such that when in use a person grasps the enlarged hand grip positioning the palm engage surface in the palm of the hand and gripping the side of the enlarged hand grip on opposite sides of the elongated handle.

1 Claim, 5 Drawing Sheets

IMPACT HAND TOOL

BACKGROUND OF THE INVENTION

Field of the Invention

An impact hand tool such as a hammer comprising an impact head and enlarged hand grip interconnected by an elongated handle.

Description of the Prior Art

A hammer is a tool consisting of a weighted "head" fixed to a long handle that is swung to deliver an impact to a small area of an object. This can be, for example, to drive nails into wood, to shape metal (as with a forge), or to crush rock. Hammers are used for a wide range of driving, shaping and breaking applications.

The claw hammer has a "claw" to pull nails out of wood and is commonly found in an inventory of household tools in North America. Other types of hammers vary in shape, size and structure depending on their purposes. Hammers used in many trades include sledgehammers, mallets and ball-peen hammers.

US 2008/0302214 relates to a striking tool comprising a U-shaped or V-shaped handle constructed of a substantially resilient material and having a head fixed at one end thereof. A second end of the handle has a hand grip adapted to be grasped by a human hand. The second end of the U-shaped or V-shaped handle includes a flange, or stop member, to inhibit the handle from slipping out of the grasping hand. The hand grip may include a lip at a lower end thereof, such that a pinky finger of the hand may be comfortably placed on either side of the lip while the hand grasps the hand grip. The resilient material construction of the handle permits a first end of the handle to flex slightly towards and away from the second end of the handle. Accordingly, during use, the striking tool provides a damped recoil and improved striking action, imparting less shock to the hand, wrist, elbow, shoulder, and other parts of the body, as compared to a conventional striking tool.

U.S. Pat. No. 7,096,761 discloses an ergonomic handle for a hand tool including a main portion extending in a longitudinal direction between a gripping portion and a tool head supporting portion opposite the gripping portion. Both the gripping portion and the tool head supporting portion are offset at an inclination in relation to the longitudinal direction of the main portion at a compound angle including a lateral angle and a vertical angle to ensure proper alignment while improving the line of sight to the tool head. The handle is configured for a hammer system in which removable fastening means secure the tool head to the handle to permit various adjustments to be made to the tool head. A tension member is also received through the handle under tension so that the handle is pre-stressed under compression for added strength.

U.S. Pat. No. 4,363,344 describes a hammer having a rigid handle composed of proximal and distal portions angularly disposed to each other, neither of which are disposed parallel or at right angle relative to the striking face of the hammer head.

US 2007/0101547 shows a new tool handle for providing an improved control, accuracy and stability for use with striking tools such as hammers of various types as well as multipurpose tools such as hatchets. The inventive device includes a shaft, a thumb ramp, a finger shield fixedly attached to the shaft and a finger positioning guide attached to the finger shield. The finger shield serves to physically restrain the tool in event of a loss of grip during use. The finger positioning guide allows a grip for a hand position for improved accuracy and control of the tool during helpful particularly with individuals having a weak hand grip or impaired freedom of finger movement.

U.S. Pat. No. 5,280,738 describes a hammer including a handle having a head pivotally connected to one end of the handle to position the head at an angle to the handle.

While some of the prior art may contain some similarities relating to the present invention, none of them teach, suggested or include all of the advantages and unique features of the invention disclosed hereafter.

SUMMARY OF THE INVENTION

The present invention relates to an impact hand tool comprising an impact head including an impact surface to engage a work piece and an enlarged hand grip to grasp the impact hand tool interconnected by an elongated handle.

The enlarged hand grip comprises a palm engaging surface and a peripheral side surface.

When in use a person grasps the enlarged hand grip by positioning the enlarged hand grip in the palm of the user such that a substantial portion of the palm engaging surface engages the palm of the person's hand while the thumb and fingers engage the peripheral side surface of the enlarged hand grip on opposite sides of the proximal end portion of the elongated handle.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
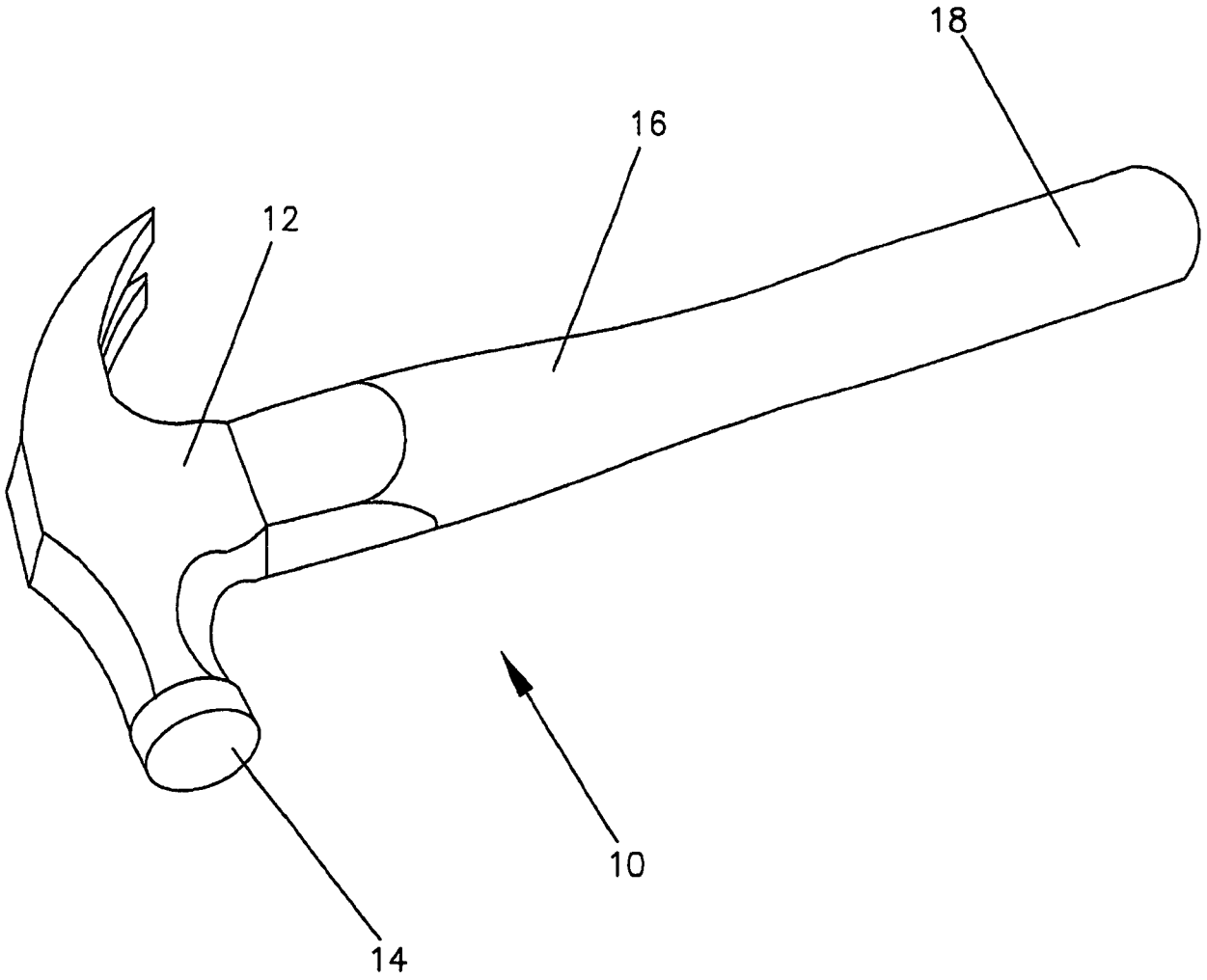
FIG. 1 is a perspective view of a prior art hammer.

As shown in FIG. 1, a typical hammer generally indicated as 10 comprises an impact head generally indicated as 12 including an impact surface 14 securely mounted to an elongated handle 16. In use, a person simply grasps the proximal end portion 18 of the elongated handle 16 by wrapping the person's fingers around the elongated handle 16, which positions the radius above the ulna. As disclosed and described below the present invention is configured to improve the ability of a user to grasp an impact hand tool.

Figure 2:
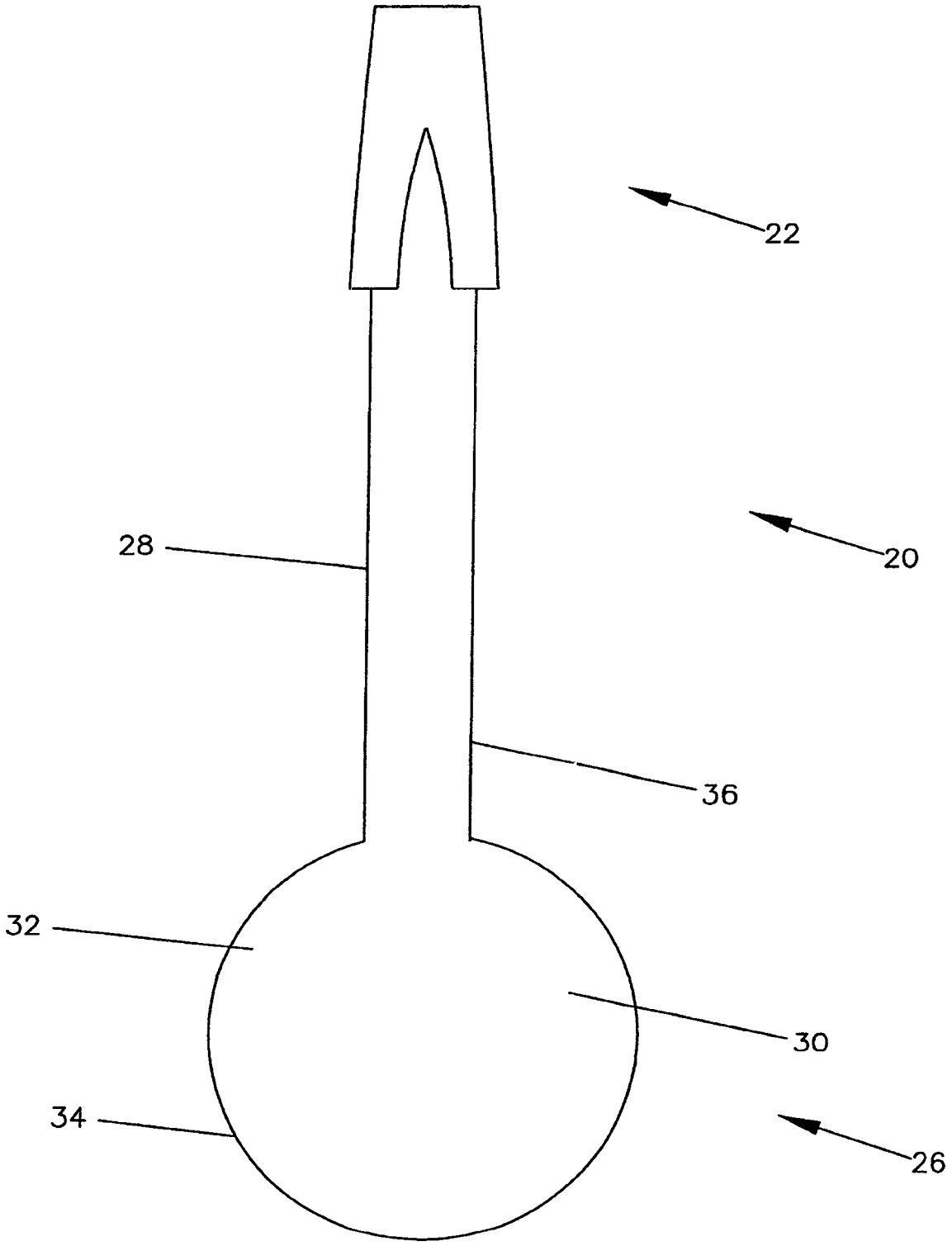
FIG. 2 is a top view of the impact hand tool of the present invention.
Figure 3:
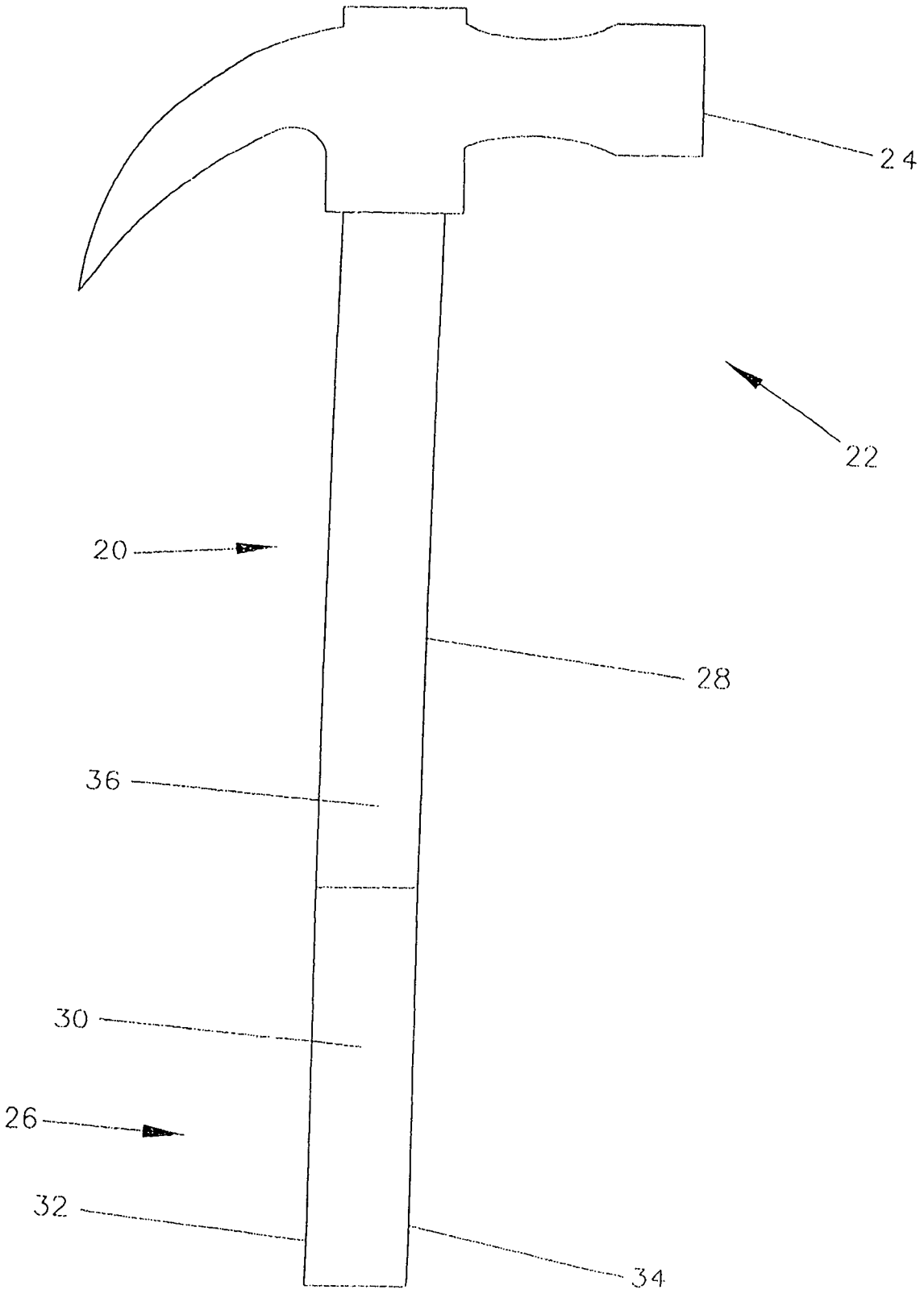
FIG. 3 is a side view of the impact hand tool of the present invention.

As shown in FIGS. 2 and 3, the impact hand tool generally indicated as 20 comprises an impact head generally indicated as 22 including an impact surface 24 to engage a work piece and an enlarged hand grip generally indicated as 26 to grasp the impact hand tool 20 interconnected by an elongated handle 28.

As depicted, the impact surface 24 may be in a plane substantially parallel to the plane in which the enlarged hand grip 26 is disposed.

The enlarged hand grip 26 comprises a substantially circular gripping member 30 including a palm engaging surface 32 and a peripheral side surface 34 extending around the periphery of the substantially circular gripping member 30.

Figure 4:
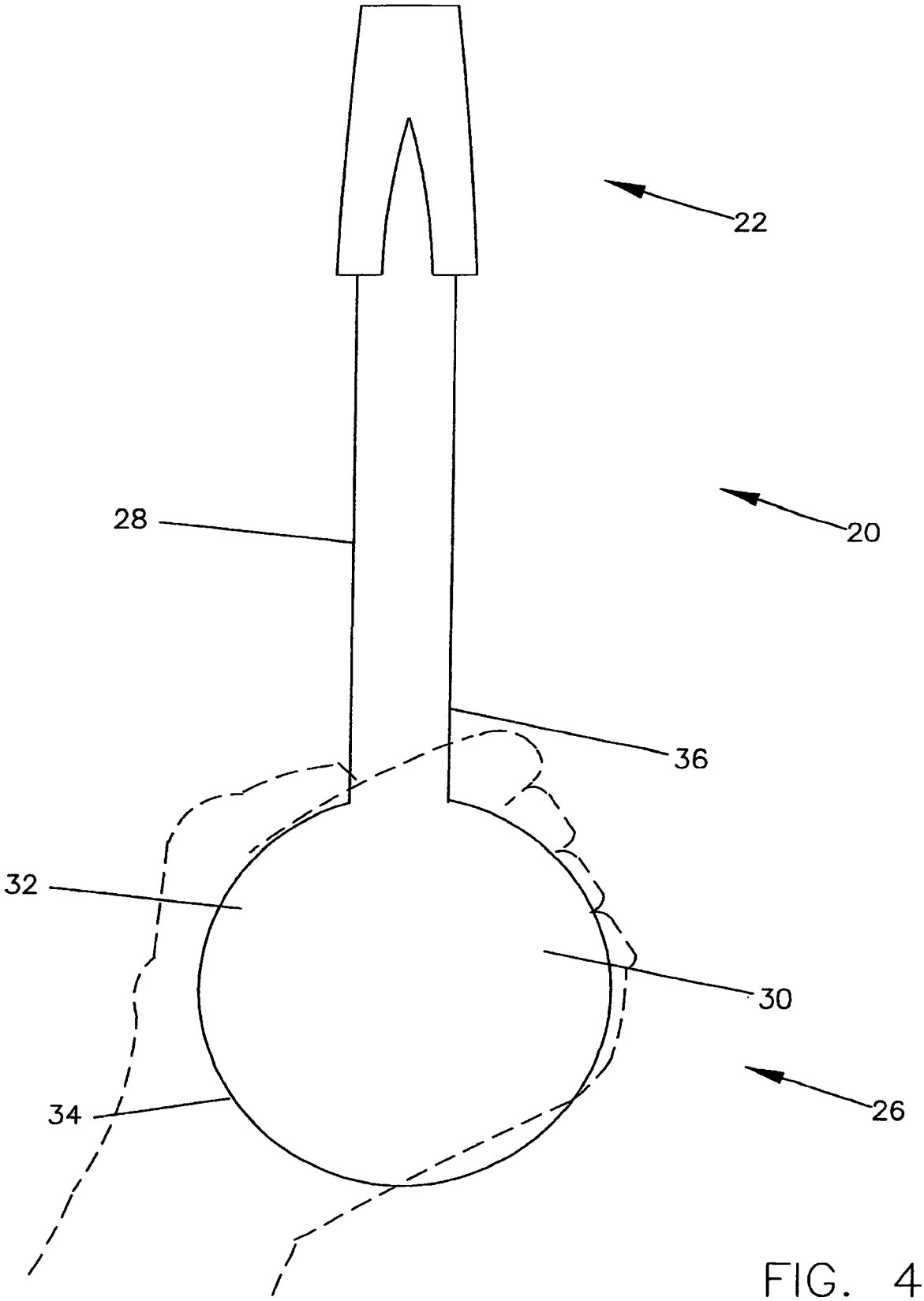
FIG. 4 is a top view of the impact hand tool of the present invention gripped by a person.

As shown in FIG. 4, when in use a person grasps the enlarged hand grip 26 by positioning the enlarged hand grip 20 in the palm of the user such that a substantial portion of the palm engaging surface 32 engages the palm of the person's hand while the thumb and fingers engage the peripheral side surface 34 of the substantially circular gripping member 30 of the enlarged hand grip 26 on opposite sides of the proximal end portion 36 of the elongated handle 28, which positions the radius alongside the ulna.

Figure 5:
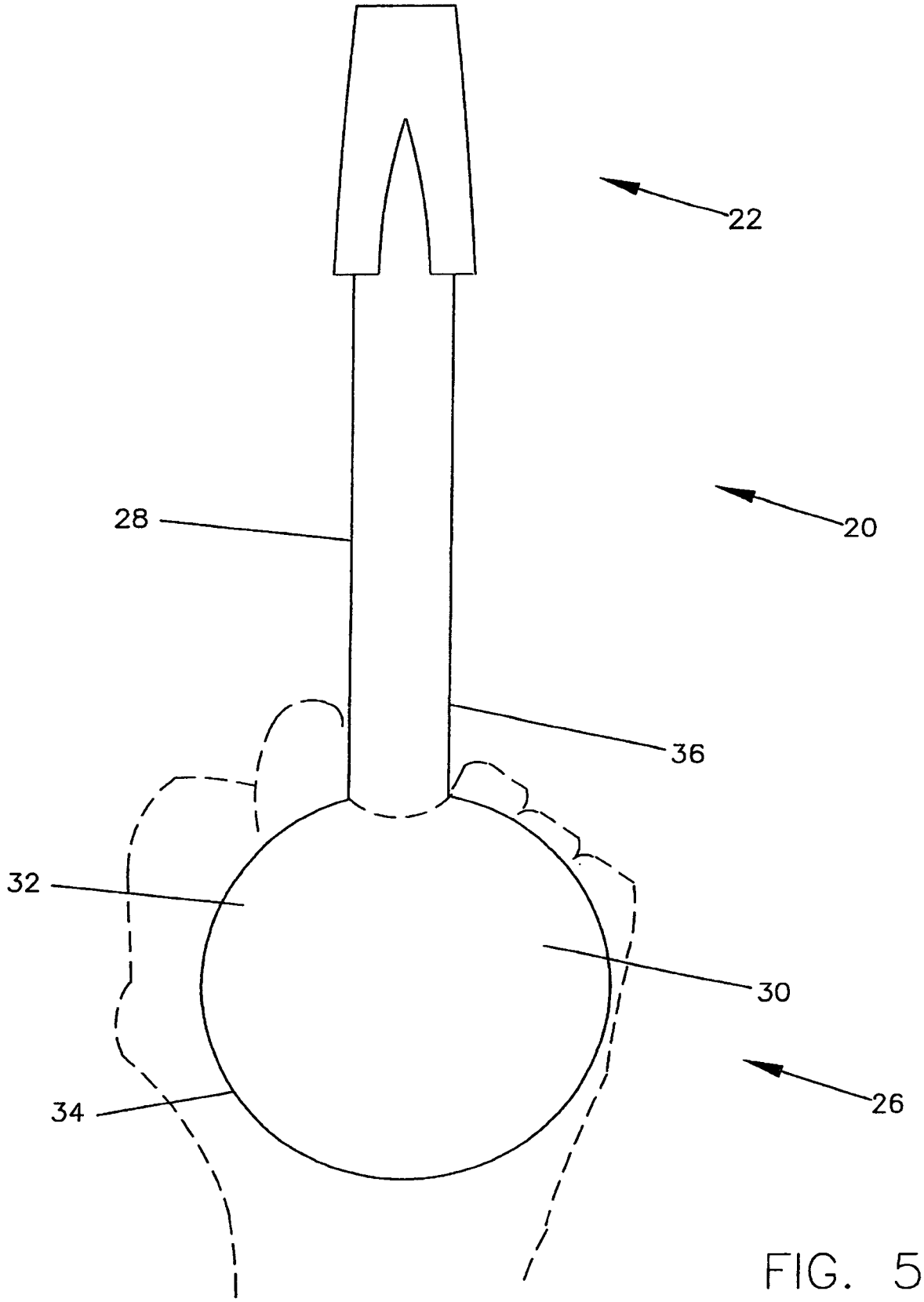
FIG. 5 is a perspective view of the impact hand tool of the present invention held by a person with a different hand grip.

FIG. 5 depicts an alternate way in which to grip the impact hand tool 20. In particular, a person grasps the enlarged hand grip 26 by positioning the enlarged hand grip 20 in the palm of the user such that a substantial portion of the palm engaging surface 32 engages the palm of the person's hand while the thumb and index finger engage the peripheral side surface 34 of the substantially circular gripping member 30 of the enlarged hand grip 26 on one side of the proximal end portion 36 of the elongated handle 28 and the other three fingers engage the peripheral side surface 34 of the substantial gripping member 30 of the enlarged hand grip 28 on the opposite side of the proximal end 36 of the elongated handle 28.

When in use, a person grasps the enlarged hand grip 26 by positioning the enlarged hand grip 20 in the palm of the user such that a substantial portion of the palm engaging surface 32 engages the palm of the person's hand while the thumb and fingers engage the peripheral side surface 34 of the substantially circular gripping member 30 of the enlarged hand grip 26 on opposite sides of the proximal end portion 36 of the elongated handle 28 with the thumb resting in recess 38 formed on the surface of the enlarged hand grip 26 adjacent the elongated handle 28.

The hand grip or grasp when using the impact hand tool 20 of the present invention is 90° from the hand grip or grasp of prior art hand tools 10. This provides a greater flex of the wrist during use, a result of positioning the radius alongside the ulna using mine vs radius above the ulna using others.

While the impact head 22 is shown as a hammer head, the impact hand tool may comprise a hatchet, pick or similar impact hand tool.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It Is to be expected that various equivalents, alternatives and modifications are possible within the scope of the claims hereinafter.

Now that the invention has been described,

What is claimed is:

1. A hand tool comprising:

an impact head comprising an elongated body that extends between a first end and a second end, the first end comprising an impact surface configured to engage a work piece; the impact surface has a diameter that extends in a plane perpendicular to a longitudinal axis of the impact head; and a handle, the handle comprising an elongated member and a gripping member;

wherein the elongated member comprises a first end that abuts the impact head, and a second end opposite to the first end of the elongated member, wherein the second end of the elongated member abuts the gripping member;

wherein the gripping member is a cylinder that comprises two flat faces that extend in respective planes that are parallel to each other and parallel to the plane of the impact surface; and wherein the cylinder further comprises a peripheral side that extends between the two flat faces;

wherein the diameter of each of the flat faces of the gripping member is larger than a width of the elongated member; and wherein the width of the elongated member extends in a direction perpendicular to the direction of the longitudinal axis of the elongated member of the handle and perpendicular to the axial direction of the cylinder.

* * * * *